US005171903A

United States Patent [19]

Koyama et al.

[11] Patent Number: 5,171,903

[45] Date of Patent: Dec. 15, 1992

[54] LUBRICATING OIL COMPOSITION

[75] Inventors: Saburo Koyama; Seiichi Shido; Kenji Onodera; Shigeo Hara; Yasunori Tomari; Toshio Saito, all of Ichihara; Tatsuo Nara, Tokyo, all of Japan

[73] Assignee: Idemitsu Kosan Co., Ltd., Tokyo, Japan

[21] Appl. No.: 699,495

[22] Filed: May 14, 1991

Related U.S. Application Data

[63] Continuation-in-part of Ser. No. 430,249, Nov. 2, 1989, Pat. No. 5,072,067.

[30] Foreign Application Priority Data

| | | | |
|---|---|---|---|
| Nov. 15, 1988 | [JP] | Japan | 63-286868 |
| Apr. 24, 1989 | [JP] | Japan | 1-101557 |
| May 14, 1990 | [JP] | Japan | 2-121361 |
| May 14, 1990 | [JP] | Japan | 2-123472 |
| May 14, 1990 | [JP] | Japan | 2-123473 |

[51] Int. Cl.[5] ..... C07C 7/20

[52] U.S. Cl. ..... 585/3; 252/49.3; 252/49.5; 585/12; 585/16; 585/17; 585/18

[58] Field of Search ..... 252/52 R, 56 R; 585/3, 585/5, 10, 18

[56] References Cited

U.S. PATENT DOCUMENTS

| | | | |
|---|---|---|---|
| 3,389,088 | 6/1968 | Schar | 252/52 R |
| 3,679,585 | 7/1972 | Brook | 252/52 R |
| 4,406,803 | 9/1983 | Liston et al. | 252/52 R |
| 5,072,067 | 12/1991 | Koyama et al. | 585/3 |

FOREIGN PATENT DOCUMENTS

| | | | |
|---|---|---|---|
| 0089709 | 9/1983 | European Pat. Off. | 252/52 R |
| 7018759 | 1/1982 | Japan | 252/52 R |
| 9015489 | 1/1984 | Japan | 252/52 R |
| 0161486 | 8/1985 | Japan | 252/52 R |

*Primary Examiner*—Asok Pal

*Attorney, Agent, or Firm*—Antonelli, Terry, Stout & Kraus

[57] ABSTRACT

A lubricating oil composition for plastic working and a lubricating oil composition for cutting and grinding which contains a straight chain olefin having 6 to 40 carbon atoms. The lubricating oil composition for plastic working or the lubricating oil composition for cutting and grinding provides excellent workability and can give the material worked an excellent finish.

14 Claims, No Drawings

LUBRICATING OIL COMPOSITION

CROSS-REFERENCE TO RELATED APPLICATION

This is a continuation-in-part of application, Ser. No. 430,249, filed Nov. 2, 1989 which issued as U.S. Pat. No. 5,072,067.

BACKGROUND OF THE INVENTION

This invention relates to a lubricating oil composition specifically for plastic working, for metal working or for cutting and grinding, as well as for use as a working metal oil solvent. More particularly, it relates to a lubricating oil composition comprising a specific linear olefin or straight chain olefin, which can finely finish the surface of a product when plastic working such as rolling, drawing, blanking, dieing out, and cold forging or in cutting and grinding.

When lubricating oil composition is used, not only workability can be improved, but also the rust resistance and wear resistance of the working tools and machinery will substantially improve resulting in longer life of the working tools.

DESCRIPTION OF THE RELATED ARTS

Until now, the workability of an oil composition for plastic working has been maintained by blending an oiliness agent or an extreme pressure agent such as alcohol, aliphatic ester, or aliphatic acid to a mineral oil or a synthetic saturated hydrocarbon oil. However, in this kind of conventional oil composition for plastic working, workability is insufficient so productivity cannot be enhanced. Furthermore, by adding the above oiliness agent or extreme pressure agent, there are various disadvantages in view of degreasing the worked portion or rust prevention.

A lubricating oil composition in which a fat and oil type oiliness agent or extreme pressure agent is added to a base oil such as a mineral oil or a synthetic oil has also been used until now for cutting and grinding. However, these conventional oil compositions have disadvantages related to surface finishing or surface detergence. Furthermore, in order to overcome these disadvantages, addition of large amounts of oiliness agents, extreme pressure agents, etc. have been attempted. However, not only could the above disadvantages not be overcome, but the surface detergence or rust preventive property of the material to be worked were also extremely deteriorated. In addition, if the surface detergence is poor, it has to be washed with solvents such as Flon, trichlene, etc., so pollution due to the solvents becomes a serious problem.

On the other hand, it has been known that a straight chain olefin improves the characteristics of lubricating oil compositions for various machines (see Japanese Patent Application Laid-open No. 15490/1984). Furthermore, it has been reported that the straight chain olefin itself shows a specific lubricating characteristic (Wear, 9 (1966) 160–168, and others).

However, each of the straight chain olefins is used as an additive for lubricating oils for generators, power machines, etc., and techniques in which this straight chain olefin is applied to plastic working including rolling, or cutting and grinding, are not known.

SUMMARY OF THE INVENTION

An object of the present invention is to provide a lubricating oil composition for achieving excellent workability when aluminum, steel, brass or other metals or alloys are subjected to plastic working.

Another object of the present invention is to provide a lubricating oil composition for plastic working that is capable of forming an excellent surface on the material to be worked or the product.

A further object of the present invention is to provide a lubricating oil composition for cutting and grinding working that is capable of forming an excellent surface state for the material to be worked or the product when cutting or grinding the above materials or alloys.

A still further object of the present invention is to provide a lubricating oil composition for cutting and grinding with excellent surface detergency, rust preventive property, wear resistance, etc., during cutting or grinding the above metals or alloys.

That is, the present invention relates to a lubricating oil composition for plastic working or cutting and grinding, which comprises a straight chain olefin having 6 to 40 carbon atoms.

In addition, this invention relates to a lubricating oil composition for metal working, comprising (i) a base oil containing, as an essential component, a straight chain olefin having 6 to 40 carbon atoms; and (ii) at least one member of compounds selected from the group consisting of alcohol, glycol, polyalkylene glycol, a derivative of polyalkylene glycol and fatty acid. The base oil also contains mineral oil and/or synthetic oil.

Also, this invention concerns a lubricating oil composition for metal working, comprising (i) a base oil containing, as an essential component, a straight chain olefin having 6 to 40 carbon atoms; and (iii) at least one member of compounds selected from the group consisting of phenolic compounds and amine compounds.

Yet another aspect of the invention provides a method of working metal materials, characterized by the step of continuously or intermittently feeding a volatile oil solution containing a straight chain olefin having not more than 14 carbon atoms and obtained by polymerization of ethylene, onto the part to be worked during working the metal material. The volatile oil solution contains (i') a straight chain olefin having not more than 14 carbon atoms, obtained by polymerization of ethylene, and (iv) at least one member of solvents having a boiling point of not higher than 300° C., selected from the group consisting of polybutene, polypropylene and alcohol having 1 to 12 carbon atoms. The volatile oil solution consists of 5 to 50 wt. % of straight chain olefin and (iv) 95 to 50 wt. % of the solvent.

Furthermore, this invention provides a metal working oil solvent comprising (i) a basic oil containing, as an essential component, a straight chain olefin having 6 to 40 carbon atoms; and (v) at least one member of emulsifiers selected from a group consisting of (1) an alkylene oxide adduct of polyhydric alcohol fatty acid ester, (2) an alkylene oxide adduct of fatty acid having 8 to 30 carbon atoms, (3) an alkylene oxide adduct of polyhydric carboxylic acid having 4 to 36 carbon atoms, (4) alkaline soap of fatty acid having 8 to 30 carbon atoms, (5) alkaline soap of polyhydric carboxylic acid having 4 to 36 carbon atoms, (6) amine soap of fatty acid having 8 to 30 carbon atoms, and (7) amine soap of polyhydric carboxylic acid having 4 to 36 carbon atoms. Also, in a method of metal working in accordance with the invention, a part to be worked is supplied with the metal working oil solvent, or a dispersion liquid of said oil solvent, and thereafter, is rinsed. Additionally, this invention provides an oil composition for working metal materials which comprises a volatile oil solution containing a straight chain olefin having not more than 14 carbon atoms and obtained by polymerization of ethylene. More specifically, the oil composition for working metal materials comprises a volatile oil solution containing (il) a straight chain olefin having not more than 14 carbon atoms, obtained by polymerization of ethylene, and (iv) at least one member of solvents having a boiling point of not higher than 300° C., selected from the group consisting of polybutene, polypropylene and alcohol having 1 to 12 carbon atoms.

DESCRIPTION OF THE PREFERRED EMBODIMENTS

A straight chain olefin (or a linear olefin) to be used in the present invention is as described above for those having 6 to 40 carbon atoms. Those having not more than 6 carbon atoms are not suitable because their flash points are low. In addition, those having more than 40 carbon atoms are not suitable because they are in a solid state, so it is difficult to use them, and yet mixing or dissolving with a base oil or other additives becomes difficult. Furthermore, those having more than 40 carbon atoms are not generally available. Among these straight chain olefins, a compound having one double bond in the molecule and having 6 to 30 carbon atoms is preferred, and in particular, an α-olefin (e.g. n-α-olefin) having 12 to 30 carbon atoms is most preferred.

Specific examples of these straight chain olefin may include 1-octene, 1-decene, 1-dodecene, 1-tetradecene, 1-hexadecene, 1-octadecene, 1-eicosene, or mixtures thereof. As these straight chain olefins, those which can be obtained by various methods may be used; for example, an ethylene oligomer obtained by polymerizing ethylene by a conventional method can be used.

In the present invention, the lubricating oil composition for plastic working may be constituted by the above straight chain olefin alone, but the straight chain olefin is preferably added in an amount of 0.5 to 99.5% by weight, more preferably 1 to 80% by weight, and most preferably 2 to 50% by weight based on the total amount of the lubricating oil composition.

On the other hand, the lubricating oil composition for cutting and grinding in the present invention may be formed by the above straight chain olefin alone as in the above lubricating oil composition for plastic working. However, in the lubricating oil composition for cutting and grinding, the preferred amount of the straight chain olefin is 0.5% by weight or more, particularly preferable is 0.5 to 80% by weight, and most preferable is 2 to 60% by weight based on the total amount of lubricating oil composition. In particular, in the case where the amount of straight chain olefin is 80% by weight or less, a remarkably improved wear resistance effect can be obtained. If the amount is less than 0.5% by weight, no improved effect in characteristics can be observed.

As the components constituting the lubricating oil composition of the present invention, there may be mentioned a base oil such as a mineral oil, synthetic oil, etc., or water, or mixtures thereof As the above base oil, those having a kinematic viscosity at 40° C. of 0.5 to 500 cSt, particularly 1 to 50 cSt are generally preferable. Mineral oils are not particularly limited and various ones may be used. For example, there are distilled oils obtained by subjecting paraffin-based crude oils, intermediate-based crude oils or naphthene-based crude oils to atmospheric pressure distillation or subjecting residual oils of atmospheric pressure distillation to vacuum distillation, or purified oils obtained by subjecting the above oils to purification according to the conventional method. More specifically, there may be mentioned solvent purified oil, a hydrogenated purified oil, dewaxing treatment oil, clay treatment oil, etc. When the above straight chain olefin is added to these mineral oils, a lubricating oil composition having an improved oxidation resistance can be obtained.

As synthetic oils to be used in combination with the above linear olefins, there may be mentioned other olefins (for example, a branched olefin such as polybutene, or polypropylene), or a hydrogenated material of the above olefins etc. Particularly preferred are low molecular weight polybutenes and low molecular weight polypropylene, and most preferable are α-olefin oligomers having 8 to 14 carbon atoms. When the above straight chain olefin is added to these synthetic oils, the resulting lubricating oil composition generates less smell during usage, improves the working environment and improves the detergency of the product's surface. In particular, a light synthetic oil in a lubricating oil composition to be used for precision cutting working is suitable as a base oil.

When water is used instead of a base oil, the lubricating oil composition becomes an emulsion in which the straight chain olefin is dispersed in the water or an emulsion in which water is dispersed in the straight chain olefin. These emulsions may be used in the present invention.

In the lubricating oil composition for plastic working or lubricating oil composition for cutting and grinding of the present invention, known oiliness agents or extreme pressure agents include various alcohols, aliphatic acids, esters, diesters, polyvalent esters, fats and oils, sulfurized fats and oils, sulfurized esters, sulfurized olefins, chlorinated paraffins, phosphate esters, amine salts of phosphate ester, phosphite esters, amine salts of phosphite ester, dithiophosphates (zinc dithiophosphate, molybdenum dithiophosphate, etc.), dithiocarbamates (molybdenum dithiocarbamate, etc.), chlorinated fats and oils may be used. In addition, various known rust inhibitors, antioxidants, corrosion inhibitors, etc. may be optionally added. Furthermore, in the lubricating oil composition for cutting and grinding, emulsifiers, sterilizers, etc. may be added when water is used.

In these cases, the amounts of oiliness agent and extreme pressure agent are not limited, but are usually added in amounts of 50 parts by weight or less, preferably 30 parts by weight or less based on 100 parts by the weight of the sum of the straight chain olefin and the base oil or water. The emulsifier may be added in an amount of 50 parts by weight or less, preferably 30 parts by weight or less, in the case of additives such as rust inhibitors, corrosion inhibitors or antifoamers, they may be each added in an amount of 30 parts by weight or less, preferably 10 parts by weight or less based on the same as the above.

As described above, the lubricating oil composition for plastic working in the present invention has excellent rolling characteristics such as lowering rolling load, increasing rolling reduction, and also gives the product a good surface finish after rolling. In particular, when it is employed for cold rolling various metals (aluminum, aluminum foil, steel (SUS304, SUS430), brass, etc.), the rolling characteristics can be improved and surface is so good that productivity and product quality can be remarkably improved.

Furthermore, when it is used as a lubricating oil composition for drawing, blanking, dieing out, cold forging, etc. various metals (aluminum alloys, pure titanium, titanium alloys, steel, etc.), there are advantages such as longer tool life or improved surface quality, as well as improved degreasing and rust preventive properties.

Accordingly, the lubricating oil composition for plastic working in the present invention can be widely and effectively utilized as a metal working fluid for plastic working such as rolling various metals and alloys.

Moreover, when cutting or grinding is carried out using the lubricating oil composition for cutting and grinding in the present invention, the surface detergence of the product can be remarkably improved, and further the surface of the material to be worked becomes good. Furthermore, wear resistance of working tools is remarkably improved so that a longer tool life can be achieved. Furthermore, it is not necessary to use a large amount of oiliness agents, extreme pressure agents, etc. and cutting and grinding can be carried out properly. Therefore, the lubricating oil composition for cutting and grinding in the present invention can be used extremely effectively for cutting and grinding various metals and alloys.

Next, the present invention is explained in more detail by referring to Examples and Comparative Examples. All "%" in the following Examples mean "% by weight".

(a) ROLLING EXPERIMENT (ROLLING OF ALUMINUM PLATE)

An aluminum plate of JIS A 3004 H16 (plate thickness of 1.2 mm, plate width of 60 mm, coil) was prepared as a rolling material, and this was rolled using a four-step roller having a work roll diameter of 135 mm under the conditions of rolling speed: 100 m/min, front tension: 150 kgf and back tension 350 kgf with the use of the following lubricating oil composition for rolling. After rolling, surface state and rolling force to the plate thickness (rolling reduction) were measured. The rolling experiment was carried out only one pass, in which the rolling reduction was raised stepwise every 20-meter rollings, and observations concerning rolling force and surface state were made.

COMPARATIVE EXAMPLE 1 (a)

Rolling (a) was carried out using a lubricating oil composition for rolling composed of a paraffinic mineral oil having a kinematic viscosity of 4 cSt at 40° C. with 6% of lauryl alcohol and 1% of butylstearate added thereto as additives.

EXAMPLE 1 (a)

Rolling (a) was carried out using a lubricating oil composition for rolling in which 2% of the paraffinic mineral oil of Comparative Example 1 (a) was replaced with a mixture of 1-hexadecene and 1-octadecene (1:1).

EXAMPLE 2 (a)

Rolling (a) was carried out using a lubricating oil composition for rolling in which 20% of the paraffinic mineral oil of Comparative Example 1 (a) was replaced with a mixture of 1-hexadecene and 1-octadecene (1:1).

EXAMPLE 3 (a)

Rolling (a) was carried out using a lubricating oil composition for rolling in which 50% of the paraffinic mineral oil of Comparative Example 1 (a) was replaced with a mixture of 1-hexadecene and 1-octadecene (1:1).

EXAMPLE 4 (a)

Rolling (a) was carried out using a lubricating oil composition for rolling in which 70% of the paraffinic mineral oil of Comparative Example 1 (a) was replaced with a mixture of 1-hexadecene and 1-octadecene (1:1).

EXAMPLE 5 (a)

Rolling (a) was carried out by using a lubricating oil composition for rolling in which all of the paraffinic mineral oil of Comparative Example 1 (a) was replaced with a mixture of 1-hexadecene and 1-octadecene (1:1).

The results are summarized in Table 1.

(b) ROLLING EXPERIMENT (ROLLING OF ALUMINUM PLATE)

An aluminum plate of JIS A 5052 H16 (plate thickness of 1.2 mm, plate width of 60 mm, coil) was prepared as a rolling material, and this was rolled in the same manner as above (a) Rolling experiment except for changing the front tension to 170 kgf and the back tension to 400 kgf.

COMPARATIVE EXAMPLE 1 (b)

Rolling (b) was carried out using the lubricating oil composition Comparative Example I (a).

EXAMPLE 1 (b)

Rolling (b) was carried out using the lubricating oil composition of Example 1 (a).

EXAMPLE 2 (b)

Rolling (b) was carried out using the lubricating oil composition of Example 2 (a).

EXAMPLE 3 (b)

Rolling (b) was carried out using the lubricating oil composition of Example 3 (a).

EXAMPLE 4 (b)

Rolling (b) was carried out using the lubricating oil composition of Example 4 (a).

EXAMPLE 5 (b)

Rolling (b) was carried out using the lubricating oil composition of Example 5 (a).

The results are summarized in Table 2.

(c) ROLLING EXPERIMENT (ROLLING OF ALUMINUM PLATE)

An aluminum plate of JIS A 1100 0 (plate thickness of 1.0 mm, plate width of 60 mm, coil) was prepared as a rolling material, and this was subjected to rolling in the same manner as in above (a) Rolling experiment, except for changing the front tension to 90 kgf and the back tension to 150 kgf.

COMPARATIVE EXAMPLE 1 (c)

Rolling (c) was carried out using the lubricating oil composition of Comparative Example 1 (a).

EXAMPLE 1 (c)

Rolling (c) was carried out using the lubricating oil composition of Example 1 (a).

EXAMPLE 2 (c)

Rolling (c) was carried out using the lubricating oil composition of Example 2 (a).

EXAMPLE 4 (c)

Rolling (c) was carried out using the lubricating oil composition of Example 4 (a).

EXAMPLE 5 (c)

Rolling (c) was carried out using the lubricating oil composition of Example 5 (a).

The results are summarized in Table 3.

TABLE 1

| Plate thickness after rolling (rolling reduction) | Comparative Example 1 (a) | | Example 1 (a) | | Example 2 (a) | | Example 3 (a) | | Example 4 (a) | | Example 5 (a) | |
|---|---|---|---|---|---|---|---|---|---|---|---|---|
| | Surface state | Rolling force (t) | Surface state | Rolling force (t) | Surface state | Rolling force (t) | Surface state | Rolling force (t) | Surface state | Rolling force (t) | Surface state | Rolling force (t) |
| 0.55 mm (54.2%) | ○ | 11.0 | ○ | 10.9 | ○ | 10.8 | ○ | 10.7 | ○ | 10.6 | ○ | 10.6 |
| 0.50 mm (58.3%) | ○ | 12.8 | ○ | 12.6 | ○ | 11.2 | ○ | 10.9 | ○ | 10.8 | ○ | 10.8 |
| 0.47 mm (60.8%) | ○ | 13.1 | ○ | 12.9 | ○ | 12.0 | ○ | 11.6 | ○ | 11.0 | ○ | 10.8 |
| 0.44 mm (63.3%) | ○ | 14.0 | ○ | 13.8 | ○ | 12.3 | ○ | 11.9 | ○ | 11.2 | ○ | 10.7 |
| 0.41 mm (65.8%) | ○ | 15.1 | ○ | 14.5 | ○ | 13.0 | ○ | 12.1 | ○ | 11.3 | ○ | 10.7 |
| 0.38 mm (68.3%) | X | 17.0 | ○ | 16.3 | ○ | 13.5 | ○ | 12.2 | ○ | 11.2 | ○ | 10.5 |
| 0.35 mm (70.8%) | — | — | X | 18.5 | ○ | 14.5 | ○ | 12.3 | ○ | 11.2 | ○ | 10.3 |
| 0.32 mm (73.3%) | — | — | — | — | X | 16.8 | ○ | 12.5 | ○ | 11.0 | ○ | 10.2 |
| 0.29 mm (75.8%) | — | — | — | — | — | — | ○ | 12.8 | Δ | 11.0 | Δ | 9.8 |

Surface state . . . ○: Normal, Δ: Cracking generated at edge portion, X: herring bone generated.

TABLE 2

| Plate thickness after rolling (rolling reduction) | Comparative Example 1 (b) | | Example 1 (b) | | Example 2 (b) | | Example 3 (b) | | Example 4 (b) | | Example 5 (b) | |
|---|---|---|---|---|---|---|---|---|---|---|---|---|
| | Surface state | Rolling force (t) | Surface state | Rolling force (t) | Surface state | Rolling force (t) | Surface state | Rolling force (t) | Surface state | Rolling force (t) | Surface state | Rolling force (t) |
| 0.60 mm (54.2%) | ○ | 12.0 | ○ | 12.0 | ○ | 11.6 | ○ | 11.5 | ○ | 11.5 | ○ | 11.5 |
| 0.55 mm (54.2%) | ○ | 13.2 | ○ | 13.0 | ○ | 11.8 | ○ | 11.7 | ○ | 11.7 | ○ | 11.7 |
| 0.50 mm (58.3%) | ○ | 14.5 | ○ | 14.2 | ○ | 12.0 | ○ | 12.0 | ○ | 12.0 | ○ | 12.0 |
| 0.47 mm (60.8%) | X | 16.1 | ○ | 15.5 | ○ | 12.5 | ○ | 12.4 | ○ | 12.3 | ○ | 12.3 |
| 0.44 mm (63.3%) | — | — | X | 16.5 | ○ | 13.1 | ○ | 13.1 | ○ | 13.1 | ○ | 13.1 |
| 0.41 mm (65.8%) | — | — | — | — | ○ | 13.5 | ○ | 13.3 | ○ | 13.2 | ○ | 13.2 |
| 0.38 mm (68.3%) | — | — | — | — | ○ | 14.1 | ○ | 14.0 | ○ | 13.5 | ○ | 13.5 |
| 0.35 mm (70.8%) | — | — | — | — | X | 16.7 | ○ | 14.7 | ○ | 14.0 | ○ | 14.0 |
| 0.32 mm (73.3%) | — | — | — | — | — | — | ○ | 15.3 | ○ | 14.6 | Δ | 14.6 |
| 0.29 mm (75.8%) | — | — | — | — | — | — | ○ | 16.0 | Δ | 15.0 | Δ | 15.0 |

Surface state . . . : Normal. : Cracking generated at edge portion, X: herring bone generated.

EXAMPLE 3 (c)

Rolling (c) was carried out using the lubricating oil composition of Example 3 (a).

TABLE 3

| Plate thickness after rolling (rolling reduction) | Comparative Example 1 (c) | | Example 1 (c) | | Example 2 (c) | | Example 3 (c) | | Example 4 (c) | | Example 5 (c) | |
|---|---|---|---|---|---|---|---|---|---|---|---|---|
| | Surface state | Rolling force (t) | Surface state | Rolling force (t) | Surface state | Rolling force (t) | Surface state | Rolling force (t) | Surface state | Rolling force (t) | Surface state | Rolling force (t) |
| 0.50 mm (50.0%) | ○ | 5.5 | ○ | 5.5 | ○ | 5.5 | ○ | 5.5 | ○ | 5.9 | ○ | 5.4 |

TABLE 3-continued

| Plate thickness after rolling (rolling reduction) | Comparative Example 1 (c) | | Example 1 (c) | | Example 2 (c) | | Example 3 (c) | | Example 4 (c) | | Example 5 (c) | |
|---|---|---|---|---|---|---|---|---|---|---|---|---|
| | Surface state | Rolling force (t) | Surface state | Rolling force (t) | Surface state | Rolling force (t) | Surface state | Rolling force (t) | Surface state | Rolling force (t) | Surface state | Rolling force (t) |
| 0.45 mm (55.0%) | ○ | 5.9 | ○ | 5.9 | ○ | 5.9 | ○ | 5.8 | ○ | 5.8 | ○ | 5.8 |
| 0.40 mm (60.0%) | ○ | 6.3 | ○ | 6.3 | ○ | 6.2 | ○ | 6.2 | ○ | 6.2 | ○ | 6.2 |
| 0.37 mm (63.0%) | ○ | 6.6 | ○ | 6.6 | ○ | 6.5 | ○ | 6.2 | ○ | 6.2 | ○ | 6.2 |
| 0.34 mm (66.0%) | ○ | 7.0 | ○ | 6.9 | ○ | 6.7 | ○ | 6.3 | ○ | 6.2 | ○ | 6.1 |
| 0.31 mm (69.0%) | ○ | 7.2 | ○ | 7.2 | ○ | 7.0 | ○ | 6.5 | ○ | 6.1 | ○ | 6.0 |
| 0.28 mm (72.0%) | X | 7.8 | ○ | 7.6 | ○ | 7.4 | ○ | 6.6 | ○ | 6.1 | ○ | 6.9 |
| 0.25 mm (75.0%) | X | 8.6 | X | 8.4 | ○ | 7.7 | ○ | 7.0 | ○ | 6.0 | ○ | 6.9 |
| 0.22 mm (78.0%) | X | 9.0 | X | 8.8 | ○ | 8.1 | ○ | 7.1 | ○ | 5.9 | ○ | 6.8 |
| 0.20 mm (80.0%) | X | 9.5 | X | 9.3 | ○ | 8.4 | ○ | 7.0 | ○ | 5.9 | X | 5.8 |

Surface state . . . : Normal, : Cracking generate at edge portion, X: herring bone generated.

ROLLING EXPERIMENT (ROLLING ALUMINUM FOIL)

Pure aluminum foil H18 (foil thickness of 0.09 mm, foil width of 60 mm, coil) was prepared as a rolling material and this was rolled using a four-step roller having a work roll diameter of 40 mm and a roll crown of 0.02 mm under the conditions of rolling speed: 100 m/min, front tension: 5 kgf and back tension: 15 kgf with the use of the following lubricating oil composition for rolling. After rolling, foil thickness and surface state to rolling force were measured. The rolling experiment was carried out only one pass, in which the rolling reduction was raised stepwise every 100 meter rolling, and observations concerning rolling force and surface state were made.

COMPARATIVE EXAMPLE 2

Rolling was carried out using a lubricating oil composition for rolling composed of a paraffinic mineral oil having a kinematic viscosity of 3.5 cSt at 40° C. with 2% of lauryl alcohol and 1% of butylstearate added thereto as additives.

EXAMPLE 6

Rolling was carried out using a lubricating oil composition for rolling in which 50% of the paraffinic mineral oil of Comparative Example 2 was replaced with a mixture of 1-dodecene and 1-tetradecene (1:1).

The results are summarized in Table 4.

TABLE 4

| Rolling force (t) | Example 6 | | Comparative Example 2 | |
|---|---|---|---|---|
| | Foil thickness | Herring bone | Foil thickness | Herring bone |
| 2 | 35 μm | None | 40 μm | None |
| 3 | 28 μm | None | 31 μm | Present |
| 5 | 22 μm | None | 25 μm | Present |
| 8 | 19 μm | None | 22 μm | Present |
| 10 | 17 μm | None | 22 μm | Present |

ROLLING EXPERIMENT WITH STAINLESS STEEL PLATE

A stainless steel plate of SUS 304 2D (plate thickness of 1.5 mm, plate width of 50 mm, coil) was prepared as a rolling material and this was rolled for 3 passes using a four-step roller having a work roll diameter of 40 mm under the conditions of rolling speed: 100 m/min, front and back tensions: 1000 kgf with the use of the following lubricating oil composition for rolling. Then, rolling for the fourth pass was carried out with front and back tensions of 750 kgf. Rolling force and surface state were observed upon changing the rolling reduction at the fourth pass.

COMPARATIVE EXAMPLE 3

Rolling was carried out using a lubricating oil composition for rolling composed of a paraffinic mineral oil having a kinematic viscosity of 8 cSt at 40° C. with 15% of butylstearate added thereto as an additive.

EXAMPLE 7

Rolling was carried out using a lubricating oil composition for rolling in which 50% of a paraffinic mineral oil of the above Comparative Example 3 was replaced with a mixture of n-α-olefin having 20 to 28 carbon atoms.

The results are summarized in Table 5.

TABLE 5

| Passed time | Plate thickness after rolling (Rolling reduction) | Example 7 | | Comparative Example 3 | |
|---|---|---|---|---|---|
| | | Rolling force | Heat scratch | Rolling force | Heat scratch |
| 1 | 1.20 mm (20.0%) | 13.0 t | None | 13.2 t | None |
| 2 | 0.98 mm (18.3%) | 14.9 t | None | 15.2 t | None |
| 3 | 0.80 mm (18.4%) | 16.0 t | None | 16.4 t | None |
| 4 | 0.57 mm (28.7%) | 16.8 t | None | 17.6 t | None |
| | 0.55 mm (28.7%) | 17.5 t | None | 18.5 t | None |
| | 0.53 mm (33.7%) | 17.9 t | None | 18.8 t | None |
| | 0.51 mm (36.2%) | 18.5 t | None | 19.3 t | Present |

ROLLING EXPERIMENT WITH BRASS PLATE

A brass plate of JIS C 2680 R ¼ H (plate thickness of 1.0 mm, plate width of 50 mm) was prepared as a rolling material and this was rolled using a two-step roller having a work roll diameter of 200 mm under the conditions of rolling speed 100 m/min, and changing front and back tensions at each pass with the use of the following lubricating oil composition for rolling. Rolling force was observed at that time.

COMPARATIVE EXAMPLE 4

Rolling was carried out using a lubricating oil composition for rolling composed of a paraffinic mineral oil having a kinematic viscosity of 4 cSt at 40° C. with 5% of butylstearate added thereto as an additive.

EXAMPLE 8

Rolling was carried out using a lubricating oil composition for rolling in which 50% of the paraffinic mineral oil of Comparative Example 4 was replaced with a mixture of 1-hexadecene and 1-octadecene (1:1).

The results are summarized in Table 6.

TABLE 6

| Passed times | Front tension | Back tension | Plate thickness after rolling | Example 8 Rolling force | Comparative Example 4 Rolling force |
|---|---|---|---|---|---|
| 1 | 300 kgf | 300 kgf | 0.603 mm | 16.8 t | 17.0 t |
| 2 | 200 kgf | 300 kgf | 0.435 mm | 20.8 t | 21.2 t |
| 3 | 160 kgf | 220 kgf | 0.328 mm | 21.5 t | 22.3 t |
| 4 | 130 kgf | 160 kgf | 0.254 mm | 19.7 t | 20.5 t |
| 5 | 100 kgf | 130 kgf | 0.200 mm | 20.5 t | 22.0 t |

(a) DRAWING EXPERIMENT

An aluminum alloy of A-2024 (plate thickness of 1.5 mm, plate width of 30 mm) was prepared as the material to be worked, and was drawn using a die made of SKS 3 and a shape (shoulder radius) of 3 mm under the conditions of die pressing force 200 to 800 kg and a drawing speed of 50 mm/min for the drawing work experiment with the use of the following lubricating oil composition for drawing. Drawing force and surface state were observed at that time.

COMPARATIVE EXAMPLE 5 (a)

The drawing experiment (a) was carried out using a lubricating oil composition for drawing composed of 85% of a paraffinic mineral oil having a kinematic viscosity of 4 cSt at 40° C. and 15% of an ester added thereto.

EXAMPLE 9 (a)

The drawing experiment (a) was carried out using a lubricating oil composition for drawing in which half the amount of the paraffinic mineral oil of Comparative Example 5 (a) was replaced with a mixture of 1-hexadecene and 1-octadecene (1:1).

The results are summarized in Table 7.

(b) DRAWING EXPERIMENT

Pure titanium of JIS 2 kind (plate thickness of 0.6 mm, plate width of 40 mm) was prepared as a material to be worked and this was subjected to the drawing experiment with the same conditions as in the above drawing experiment (a) with the use of the following lubricating gel composition for drawing, and drawing force and surface state at that time were observed COMPARATIVE EXAMPLE 5 (b)

The drawing experiment (b) was carried out by using a lubricating oil composition for drawing composed of 85% paraffinic mineral oil having a kinematic viscosity of 4 cSt at 40° C. and 15% of an ester added thereto.

EXAMPLE 9 (b)

The drawing experiment (b) was carried out using a lubricating oil composition for drawing in which half the amount of the paraffinic mineral oil of Comparative Example 5 (b) was replaced with a mixture of 1-hexadecene and 1-octadecene (1:1).

The results are summarized in Table 8.

TABLE 7

| No. | Die pressing force (kg) | Maximum drawing force (kg) | Average drawing force (kg) | Surface state |
|---|---|---|---|---|
| Example 9 (a) | 400 | 210 | 195 | Normal |
| | 600 | 360 | 325 | Normal |
| | 800 | 500 | 415 | |
| Comparative Example 5 (a) | 400 | 255 | 220 | Normal |
| | 600 | 380 | 350 | Normal |
| | 800 | 605 | 520 | Dragging (slight) |

TABLE 8

| No. | Die pressing force (kg) | Maximum drawing force (kg) | Average drawing force (kg) | Surface state |
|---|---|---|---|---|
| Example 9 (b) | 200 | 330 | 290 | Normal |
| | 300 | 410 | 385 | Normal |
| | 400 | 520 | 495 | Dragging (slight) |
| Comparative Example 5 (b) | 200 | 370 | 355 | Normal |
| | 300 | 455 | 440 | Dragging (moderate) |
| | 400 | 585 | 560 | Dragging (serious) |

BLANKING EXPERIMENT

An aluminum plate of JIS A 1100-H26 (plate thickness of 0.10 mm) was prepared to be worked. Using a 50 ton-press (produced by Burr Oak Co.) exclusively for aluminum fin molding, a blanking experiment was carried out under the conditions of tool material of high speed steel, stroke speed of 0.5 m/sec, thickness reduction of 55%, molding hole shape of 2.5/8 inches and working time of 300 cycle/min×5 min with the use of the following lubricating oil composition for blanking.

EXAMPLE 10

The blanking experiment was carried out using a lubricating oil composition for blanking composed of 95% of a paraffinic mineral oil having a kinematic viscosity of 4 cSt at 40° C. and 5% of a mixture of 1-hexadecene and 1-octadecene (1:1).

EXAMPLE 11

The blanking experiment was carried out using a lubricating oil composition for blanking composed of 90% of a paraffinic mineral oil having a kinematic viscosity of 4 cSt at 40° C. and 10% of a mixture of 1-hexadecene and 1-octadecene (1:1).

EXAMPLE 12

The blanking experiment was carried out using lubricating oil composition for blanking composed of 80% of a paraffinic mineral oil having a kinematic viscosity of 4 cSt 40° C. and 20% of a mixture of 1-hexadecene and 1-octadecene (1:1).

EXAMPLE 13

The blanking experiment was carried out using a lubricating oil composition for blanking composed of 50% of a paraffinic mineral oil having a kinematic viscosity of 4 cSt at 40° C. and 50% of a mixture of 1-hexadecene and 1-octadecene (1:1).

EXAMPLE 14

The blanking experiment was carried out using a lubricating oil composition for blanking composed of 20% of a paraffinic mineral oil having a kinematic viscosity of 4 cSt at 40° C. and 80% of a mixture of 1-hexadecene and 1-octadecene (1:1).

EXAMPLE 15

The blanking experiment was carried out using only a mixture of 1-hexadecene and 1-octadecene (1:1) as a lubricating oil composition for blanking.

EXAMPLE 16

The blanking experiment was carried out using a lubricating oil composition for blanking composed of 20% of a mixture of 1-hexadecene and 1-octadecene (1:1) and 80% of a polybutene (molecular weight 265).

COMPARATIVE EXAMPLE 6

The blanking experiment was carried out using only a paraffinic mineral oil having a kinematic viscosity of 4 cSt at 40° C. as a lubricating oil composition for blanking

COMPARATIVE EXAMPLE 7

The blanking experiment was carried out by using a lubricating oil composition for blanking composed of 90% of a paraffinic mineral oil having a kinematic viscosity of 4 cSt at 40° C. and 10% of butylstearate.

The result are summarized in Table 9.

TABLE 9

| No. | Thickness*1 reduction | Tool abrasion*2 | Odor*3 |
|---|---|---|---|
| Example 10 | 20 | None | |
| Example 11 | 9 | None | |
| Example 12 | 5 | None | |
| Example 13 | 0 | None | |
| Example 14 | 5 | Minute amount present | |
| Example 15 | 12 | Present | |
| Example 16 | 2 | None | |
| Comparative | 58 | None | |

TABLE 9-continued

| No. | Thickness*1 reduction | Tool abrasion*2 | Odor*3 |
|---|---|---|---|
| Example 6 | | (Cohesion present) | |
| Comparative Example 7 | 28 | None | |

*1Thickness reduction is shown by defective ratio (%).
*2Abrasion at punch ironing portion is shown.
*3Sensitive test by 5 panelists 3 m from a press portion was carried out and judged as shown below.
◎ No members notice malodor.
○ one panelist noticed malodor.
Δ Three or more panelists noticed malodor.

EXAMPLES 17 TO 27 AND COMPARATIVE EXAMPLES 8 AND 9

Using the lubricating oil compositions for cutting and grinding shown in Table 10, evaluations regarding the surface roughness of a material to be worked, wear resistance of a tool and surface detergency of an aluminum plate were carried out for drilling work. The results are shown in Table 10.

(1) Evaluation methods for surface roughness and wbar resistance

Using an aluminum-silicon alloy casting (JIS AC8A), an air feed drill as a working machine and HSS twist drill (inner diameter: 3.3 mm) as a drill, drilling was carried out to a depth of 20 mm and a lubricating oil composition was supplied at 1.0 liter/min.

Surface roughness ($R_{max}$) was measured after working 10 materials and was evaluated as an index of surface finishing.

Wear resistance was evaluated as maximum wear width or depth (μ) at a drill margin portion after working of 200 materials to be worked as an index.

(2) Evaluating method of surface detergency

On the surface of a mirror-finished aluminum plate (50 mm×50 mm), one drop (about 0.02 ml) of a lubricating oil composition was dropped and allowed to stand at 60° C. for 3 hours in a thermostat; then the surface was observed and evaluated by the following standards

| Evaluation | |
|---|---|
| No cloud (oil stain) with mirrored surface | A |
| Extremely minor cloud (oil stain) with mirrored surface | B |
| Slight cloud (oil stain) with mirrored surface | C |
| Remarkable cloud (oil stain) with mirrored surface | D |

TABLE 10

| No. | Composition: Straight chain olefin | % by weight | Base oil | % by weight | Additives | Parts*6 by weight | Surface roughness (μ) | Wear resistance (μ) | Surface detergency |
|---|---|---|---|---|---|---|---|---|---|
| Example 17 | Olefin I*1 | 100 | — | 0 | — | 0 | 8 | 440 | A |
| Example 18 | Olefin I*1 | 100 | — | 0 | Oiliness, extreme*5 pressure agents | 10 | 7 | 400 | B |
| Example 19 | Olefin I*1 | 50 | Mineral oil*3 | 50 | Oiliness, extreme*5 pressure agents | 10 | 6 | 340 | C |
| Example 20 | Olefin I*1 | 20 | Mineral oil*3 | 80 | Oiliness, extreme*5 pressure agents | 10 | 7 | 310 | C |
| Example 21 | Olefin I*1 | 5 | Mineral oil*3 | 95 | Oiliness, extreme*5 pressure agents | 10 | 8 | 300 | C |
| Example 22 | Olefin II*2 | 50 | Synthetic oil*4 | 50 | Oiliness, extreme*5 pressure agents | 10 | 6 | 350 | B |
| Example 23 | Olefin II*2 | 20 | Synthetic oil*4 | 80 | Oiliness, extreme*5 pressure agents | 10 | 6 | 325 | B |
| Example 24 | Olefin II*2 | 5 | Synthetic oil*4 | 95 | Oiliness, extreme*5 pressure agents | 10 | 7 | 300 | B |
| Example 25 | Olefin II*2 | 50 | Synthetic oil*4 | 50 | — | 0 | 9 | 260 | A |
| Example 26 | Olefin II*2 | 50 | Mineral oil*3 | 50 | — | 0 | 9 | 200 | B |

TABLE 10-continued

| No. | Composition: Straight chain olefin | % by weight | Base oil | % by weight | Additives | Parts*6 by weight | Surface roughness (μ) | Surface resistance (μ) | Wear Surface detergency |
|---|---|---|---|---|---|---|---|---|---|
| Example 27 | Olefin II*2 | 50 | Synthetic oil*4 | 50 | Oiliness, extreme*5 pressure agents | 1 | 6 | 230 | A |
| Comparative Example 8 | — | — | Mineral oil*3 | 100 | — | 0 | 64 | Drill*7 rupture | D |
| Comparative Example 9 | — | — | Mineral oil*3 | 100 | Oiliness, extreme*5 pressure agents | 10 | 12 | 480 | D |

*1Equal mixture of 1-hexadecene and 1-octadecene
*2Equal mixture of 1-dodecene and 1-tetradecane
*3Paraffin type mineral oil (kinematic viscosity at 40° C. of 8 cSt)
*4Light weight polybutene (kinematic viscosity at 40° C. of 1.2 cSt)
*5Mixture of chlorinated paraffin and fats and oils (1:1)
*6Formulating amount based on 100 parts by weight of sum of straight chain olefin and base oil is shown.
*7Drill ruptured at the 105th specimen.

In the lubricating oil composition for metal working, the straight chain olefin constituting a component of a base oil is the same as that heretofore described for the lubricating oil for plastic working The mineral oil, synthetic oil or water can be also used together with the above-mentioned straight olefin.

The component (ii) is obtained, as heretofore described, by using one or more kinds among alcohol, glycol, polyalkylene glycol, a derivative of polyalkylene glycol and fatty acid.

Among many kinds of alcohol, aliphatic alcohol is preferably used. Alcohol of branching saturated or unsaturated aliphatic group having 6 to 40 carbon atoms (especially 8 to 30 carbon atoms), or alcohol of straight-chain saturated or unsaturated aliphatic group having 6 to 20 carbon atoms (especially 8 to 18 carbon atoms) is more preferable. The alcohol having less than 6 carbon atoms is consumed at a high rate due to evaporation or splashing during use, and accordingly, is not economically advantageous. Meanwhile, branched alcohol having greater than 40 carbon atoms or straight chain alcohol having greater than 20 carbon atoms is sometimes undesirable when it is insoluble in the base oil as the component (i).

As specific examples of alcohol, there can be exemplified octyl (2-ethylhexyl) alcohol, decyl alcohol, lauryl alcohol, myristyl alcohol, cetyl alcohol, stearyl alcohol, eicosyl alcohol, oleyl alcohol, isostearyl alcohol, oxoalcohol and the like. The blending ratio thereof is usually 0.05 to 50 wt. % of the entire composition, and it is preferably 0.1 to 20 wt. %.

Next, as to the glycol, various kinds may be used. In general, there may be exemplified glycol having 2 to 6 carbon atoms: for example, ethylene glycol, propylene glycol, trimethylene glycol, 1,4-butanediol; 1,5-pentanediol and the like. The blending ratio thereof is 0.05 to 50 wt. %, preferably, 0.1 to 20 of the entire composition, similar to that of the above-mentioned alcohol. Further, there are various kinds of the polyalkylene glycol or derivatives thereof, and among these, the compound which is exhibited by the following general formula (I):

$$R^1—O(R^2—O)_n—R^3 \quad (I)$$

(where $R^1$ and $R^3$ denote independently a hydrogen, an alkyl group having 1 to 20 carbon atoms, an alkyl-substituted phenyl group having 7 to 24 carbon atoms or a phenyl group, $R^2$ denotes an ethylene group, a propylene group or a butylene group, and n is an integer of 2 to 50) is preferable. More specifically, there can be exemplified poly(n=6)ethyleneglycol-monobutylether, poly(n=5)propyleneglycol-monononylether, poly(n=10)ethyleneglycol-dipropylether and the like A glycerol derivative of polyethylene glycol or a fatty acid ester of polyethylene glycol, other than the compound given by the above-mentioned general formula (I) can be similarly used. The blending ratio thereof is usually 0.05 to 50 wt. % preferably 0.1 to 20 wt. % of the entire composition, similar to that of the above-mentioned alcohol.

Further, as to the fatty acid, there may be exemplified straight chain or branching, and saturated and unsaturated fatty acid usually having 6 to 40 carbon atoms (preferably 8 to 20 carbon atoms). It is noted here that those having less than 6 carbon atoms are largely consumed due to evaporation or splashing during use while those having greater than 40 carbon atoms, there is a fear such that it sometimes is insoluble in the base oil which is the component (i). As to specific and preferable examples of such a fatty acid, there may be exemplified caprylic acid, capric acid, lauric acid, myristic acid, palmitic acid, stearic acid, arachic acid, behenic acid, isostearic acid, undecylenic acid, oleic acid, linoleic acid, linolenic acid, arachidonic acid, and the like Further, the blending ratio thereof is usually 0.05 to 1.0 wt. % of the entire composition. If the blending ratio of the fatty acid exceeds 1.0 wt. %, the annealing ability thereof decreases, and accordingly, it is undesirable.

The composition according to the present invention, which comprises the above-mentioned components (i) and (ii), may be blended therewith at least one kind among a phenolic compound and an amine compound as the component (iii). It is noted here that among various kinds of phenolic compound which can be used, usually, there may be exemplified those exhibited by the following general formula (II) or (III):

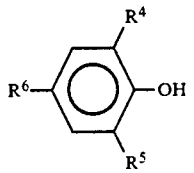

(II)

-continued (III)

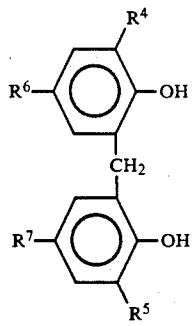

(where $R^4$ and $R^5$ denote an alkyl group having 1 to 8 carbon atoms, and $R^6$ and $R^7$ denote a hydrogen or an alkyl groups having 1 to 6 carbon atoms. Specifically, there may be preferably exemplified 2,6-di-tert-butyl-4-methylphenol (DPBC), 2,6-di-tert-butyl-4-ethylphenol, 2,2'-methylenebis (4-ethyl-6-tert-butylphenol) and the like.

Meanwhile, among various kinds of amine compounds which can be used, there can be exemplified those which are usually given by the following general formula (IV) or (V):

(IV)

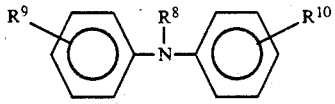

(V)

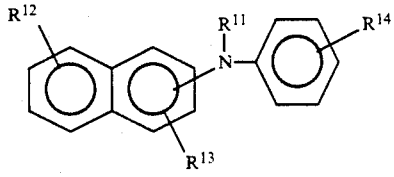

(where $R^8$ and $R^{11}$ denote a hydrogen or an alkyl group having 1 to 10 carbon atoms while $R^9$ and $R^{10}$ denote an alkyl group having 1 to 20 carbon atoms, and $R^{12}$ to $R^{14}$ denote a hydrogen or an alkyl group having 1 to 20 carbon atoms. Specifically, there may be preferably exemplified di-p-octyldiphenylamine, di-p-butyldiphenylamine, di-p-dinonylphenylamine, phenyl-α-naphthylamine, phenyl-β-naphtyleamine and the like.

The blending ratio of this component (iii) is preferably not less than 0.1 wt. % and more preferably 0.1 to 2.0 wt. % of the entire composition.

It is noted here that this composition can be blended with a suitable quantity of well-known oiliness agent, extreme-pressure agent, rust inhibitor, corrosion inhibitor, defoaming agent or the like.

EXAMPLES 28 TO 39 AND COMPARATIVE EXAMPLES 10 TO 12

The following rolling test was carried out with the use of lubricating oils for rolling, with details shown in Table 11.

ROLLING TEST (ALUMINUM PLATE ROLLING)

A JIS A 5052 H16 aluminum plate (a coiled plate having a thickness of 1.2 mm and a width of 60 mm) which had been prepared as a material to be rolled, was rolled with each lubricating oil for rolling, by using a four-stage rolling mill having a work roll diameter of 135 mm at a rolling speed of 100 m/min and under forward tensions 170 kgf and 400 kgf. It is noted here that the rolling process was carried out in such a way that the draft was steppedly increased per 20 m length during one pass as follows: 50.0, 54.2, 58.3, 60.8, 63.3, 65.8 and then 68.3 (%), and that depression forces of those having 0.38 mm (a draft of 68.3 %) after the rolling (after seven passes) was measured, and further, abrasion dust detergency, and annealing ability and depression force were evaluated by methods which will be explained as follows:

(a) EVALUATION METHOD FOR ABRASION DUST DETERGENCY

A cellophane tape was stuck onto the surface of an aluminum plate after rolling so as to take up abrasion dust adhering thereto. Then, the tape was applied on a white paper sheet to visually determine a degree of contamination, and accordingly, the detergency for abrasion dust sticking on the surface of the aluminum plate was evaluated. The results thus obtained are shown in Table 11.

(b) EVALUATION METHOD FOR ANNEALING ABILITY

An aluminum plate after rolling was cut into pieces having a short length of 10 cm, and ten of the cut pieces were stacked one upon another and fixed by a thick steel plate and were annealed in a small size annealing furnace.

The annealing condition of the furnace was such that they were heated up to 330° C. at a temperature rising rate of 5° C./min under an air atmosphere, and were then cooled after holding for 30 min. After completion of the heating, a degree of occurrence of annealing stains on the annealed plate was visually determined so as to evaluate the annealing ability. The results are shown in Table 11.

TABLE 11

| | Example | | | | | | | | | | | | Comparative Example | | |
|---|---|---|---|---|---|---|---|---|---|---|---|---|---|---|---|
| | 28 | 29 | 30 | 31 | 32 | 33 | 34 | 35 | 36 | 37 | 38 | 39 | 10 | 11 | 12 |
| Composition (wt. %) | | | | | | | | | | | | | | | |
| n-1-olefin*1 | 40 | 40 | 40 | 30 | 30 | 30 | 30 | 30 | 30 | 95 | 40 | 40 | 100 | 97 | — |
| Mineral oil*2 | 56.5 | 54.5 | 54.5 | 69 | 69 | 69 | 65 | 60 | — | — | 59.5 | 59.5 | — | — | 94.5 |
| Polybutene*3 | — | — | — | — | — | — | — | — | 69 | — | — | — | — | — | — |
| Decyl alcohol | 3 | — | — | — | — | — | — | — | — | — | — | — | — | — | — |
| Lauryl alcohol | — | 5 | — | — | — | — | 5 | — | — | 5 | — | — | — | — | 5 |
| Oleyl alcohol | — | — | — | — | — | 1 | — | — | — | — | — | — | — | — | — |
| Oxo alcohol | — | — | 5 | — | — | — | — | 10 | — | — | — | — | — | — | — |
| Lauric acid | — | — | — | 0.5 | — | — | — | — | 1 | — | — | — | — | — | — |
| Oleinic acid | — | — | — | — | 0.5 | — | — | — | — | — | — | — | — | — | — |
| 2,6-di-t-butyl-4-methylphenol | 0.5 | 0.5 | 0.5 | 0.5 | — | — | — | — | — | — | 0.5 | — | — | — | 0.5 |

TABLE 11-continued

| | Example | | | | | | | | | | | | Comparative Example | | |
|---|---|---|---|---|---|---|---|---|---|---|---|---|---|---|---|
| | 28 | 29 | 30 | 31 | 32 | 33 | 34 | 35 | 36 | 37 | 38 | 39 | 10 | 11 | 12 |
| Dioctyl phenylamine | — | — | — | — | 0.5 | — | — | — | — | — | — | 0.5 | — | — | — |
| Methyl laurate | — | — | — | — | — | — | — | — | — | — | — | — | — | 3 | — |
| Abrasion dust detergency*4 | ○ | ○ | ○ | ○ | ○ | ○ | ○ | ○ | ○ | ○ | Δ | Δ | x | x | ○ |
| Annealing ability*5 | ○ | ○ | ○ | ○ | ○ | Δ | Δ | Δ | Δ | Δ~x | Δ | Δ | x | x | ○ |
| Depression force (ton) | 14.6 | 14.2 | 14.1 | — | — | — | — | 14.7 | — | — | 14.6 | — | — | — | Unable |

*1An equiweight mixture of 1-hexadecene and 1-octadecene
*2A paraffinic mineral oil having a kinematic viscosity of 4 cSt at 40° C.
*3The one having a kinematic viscosity of 6 cSt at 40° C.
*4○ indicates little contamination and Δ indicates moderate contamination and x indicates excessive contamination.
*5○ indicates little stain, Δ indicates moderate stain and x indicates excessive stain.

EXAMPLES 40, 41 AND COMPARATIVE EXAMPLES 13, 14

The following Cutting Test was carried out with the use of lubricating oil for cutting, with details shown in Table 12:

CUTTING TEST (CUTTING FOR END FACE OF CYLINDER)

A cylindrical aluminum alloy material (AC-4A-T6) having a diameter of 80 mm, which had been prepared as a material to be cut, was cut for forming an end face thereof with the use of a cutting tool (cemented carbide P20) under such a condition that a cutting depth (t) was 1 mm, and a feed rate (f) was 0.1 mm/revolution. After the cutting, the surface roughness ($R_{max}$) of the cut end face are measured while the surface thereof were observed The results are shown in Table 12.

TABLE 12

| | Example 40 | Example 41 | Comparative Example 13 | Comparative Example 14 |
|---|---|---|---|---|
| n-1-olefin*1 (wt. %) | 40 | 90 | 100 | — |
| Mineral oil*2 (wt. %) | 50 | — | — | 100 |
| Lauryl alcohol (wt. %) | 10 | 10 | — | — |
| Roughness ($R_{max}$) (μm) | 2 | 2 | 5 | 10 |
| Result of observation | Feed mark alone (theoretical roughness) | Feed mark alone (theoretical roughness) | Disturbance in feed mark | Sticking of fragments from the cutting edge of a structural component |

*1,2the same as that in Table 11

Among various metal materials which can be worked by the methods of this invention, there can be specifically exemplified, as preferable materials, (1) plate materials made of aluminum, aluminum alloys, and those obtained by rolling, shearing, cutting these materials, and so forth, and (2) those obtained by roughing an aluminum alloy material into a disc-like shape or the like.

Further, the working process carried out by the above-mentioned method, consists of only one process or numerous processes in combination. It is noted that there are various kinds of working such as, drawing, ironing, punching, ring-forging, curling, superfinishing and the like. In this method, one process is carried out solely, two or more kinds of processes are carried out in combination, or one and the same kind of a process is repeated by a certain number of times.

As a specific working method, there may be exemplified a fin forming process for forming aluminum fins of household air-conditioners, vehicle air-conditioners or the like and a forming process for a magnetic disc. As the fin forming process, a drawless type working process is, for example, exemplified, which is in combination with a punching process, an ironing process and a curling process. Further, the magnetic disc forming process is in combination of superfinishing processes, and more precisely, the A-side surface of a disc is subjected to an ultraprecise working process after a roughing process on both sides, and is then the B-side surface thereof is subjected to the ultraprecise working process before being mirror-surface finished.

Next, as mentioned above, a working oil solvent adapted to be used in the above-mentioned method, is (i') a volatile oil solvent containing straight chain olefin having not more than 14 carbon atoms, which is obtained by polymerization of ethylene. Incidentally, the straight chain olefin is an oligomer in which 3 to 7 of ethylenes are polymerized, and is constituted by one or more kinds thereof in combination. Herein, the straight chain olefin includes straight chain-1-olefin and straight chain-2-olefin. It is noted that the above-mentioned straight chain olefin has not more than 14 carbon atoms, but it may contain therein less than 50 wt. % of that having not less than 15 carbon atoms.

The thus used volatile oil solvent may consists of the above-mentioned (i') straight chain olefin alone, but is preferably used in combination with (i') straight chain olefin and (iv) a solvent which is at least one kind of compounds selected from the group consisting of polybutene, polypropylene and alcohol having 1 to 12 carbon atoms and which has a boiling point of not more than 300° C., preferably less than 250° C. It is noted here that polybutene constituting the solvent having a boiling point of not more than 300° C. is a homopolymer of isobutene or a copolymer of isobutene and n-butene, and further, the polypropylene is a homopolymer of polypropylene or a copolymer of polypropylene and ethylene or butene, either of them having a relatively low molecular weight. Further, as the alcohol having 1 to 12 carbon atoms, there can be exemplified methyl alcohol, ethyl alcohol, propyl alcohols, butyl alcohols, amyl alcohols, hexyl alcohols, octyl alcohols, nonyl alcohols and the like.

The above-mentioned (iv) solvent should have a boiling point of not more than 300° C. If it has a boiling point of higher than 300° C., it is undesirable since the degreasing ability thereof decreases.

Although no specific limitation is given to the blending ratio of (i') the straight chain olefin and (iv) the solvent in the volatile oil solvent in this method, a range of 2 to 98 wt. %, preferably 5 to 50 wt. %, for (i') the straight chain olefin, and a range of 98 to 2 wt. %, preferably 95 to 50 wt. %, for (iv) the solvent are selected.

This volatile oil solvent is composed of the above-mentioned (i') straight chain olefin alone or a mixture of this (i') straight chain olefin and (iv) the solvent, but further, if desired, it can be suitably added thereto with several kinds of additives such as antioxidants, corrosion inhibitors, oiliness agents, extreme pressure agents or the like in a range of not more than 10 wt. %.

In the above-mentioned method, the above volatile oil solvent is intermittently or continuously fed onto the part of the metal material to be worked as an object during the initial or intermediate stage of the working process. In this phase, the supply of the oil can be made by various ways, that is, dipping, coating and the like, but it is especially preferable by misting the oil solvent. Further, cooling of the above-mentioned volatile oil solvent to 0° to 15° C. is more effective.

EXAMPLE 42 (ULTRAPRECISE WORKING TEST (MIRROR-SURFACE FINISHING OF MAGNETIC DISC)):

A disc substrate (having a diameter of 5 in.) which had been fabricated by cutting, punching and roughing (NC-lathing) a coiled material of aluminum alloy (A5052 material) was subjected to an ultraprecise working process under the following condition:

This working process was made in such a way that the Aside surface of the disc was worked and then the B-side thereof was worked soon thereafter with a degreasing process being eliminated.

The result of this test is shown in Table 13.

Condition:

Working Machine: Lathe
Tool: diamond single crystal cutting tool
Rotational Speed: 500 rpm
Feed Rate: 0.03 mm/revolution
Cutting Depth: 15 μm
Volatile Oil: a mixture of straight chain-1-olefin (a mixture of $C_{12}$ and $C_{14}$) and polybutene (having a boiling point of 165° to 200° C.) with the ratio by weight of 30:70
Oil Feed: oil-mist feeding (the oil supply tank was cooled to a temperature of less than 5° C. before feeding)

COMPARATIVE EXAMPLE 15

An ultraprecise working test similar to that in the Example 42 was carried out, except that polybutene (having a boiling point of 165° to 200° C.) was used solely as the volatile oil solvent.

The results of this test are shown in Table 13.

COMPARATIVE EXAMPLE 16

An ultraprecise working test was carried out similar to the Example 42, except that a mixture of paraffinic mineral oil (having a kinematic viscosity of 8 cSt at a temperature of 40° C.) and olefinic acid with a weight ratio of 98:2 was used as the volatile oil The results of this test are shown in Table 13.

TABLE 13

| | Example 42 | Comparative Example 15 | Comparative Example 16 |
|---|---|---|---|
| Workability | Feed mark alone (theoretical roughness) | Peel | Feed mark alone (theoretical roughness) |
| Degreasing ability | No oil sticking | No oil sticking | Much oil sticking |
| Working Condition (Odor) | Satisfactory | Satisfactory | Odor of kerosene |

EXAMPLE 43 (ALUMINUM FIN WORKING TEST)

An aluminum plate (A1200) having a thickness of 0.110 mm and coated thereover with water glass was subjected to the so-called drawless type working process so as to successively form aluminum fins for a household air-conditioner. That is, the aluminum plate was dipped in the oil solvent, and thereafter, was subjected to a piercing process (drilling), a burring process, an ironing process and a reflaring process. The condition of the ironing process was as follows:

Punch (cemented carbide) Outer Diameter: 9.86 mm
Dies (cemented carbide) Inner Diameter: 9.86 mm
Fin Pitch: 1.6 mm
Ironing Rate: 54%

Further, the oil supply was made by misting a mixture of a volatile oil (straight chain-1-olefin (a mixture of $C_{12}$ and $C_{14}$)) and polybutene (having a boiling point of 165° to 200° C.) with a weight ratio of 20:80, which was fed from an oil tank which had been cooled to a temperature of 5° C., during the ironing process.

Further, the successive working process was made by the piercing process so as to form 32 holes per row and 100,000 strokes was made at a working rate of 250 strokes/min.

As a result, the occurrence of color irregularity on and the occurrence of seizure in the ironed part were not found, and further, no oil solvent stuck thereto so that no degreasing process was required.

COMPARATIVE EXAMPLE 17

An aluminum fine working test was carried out similar to the Example 43, excepting polybutene (having a boiling point of 165° to 200° C.) was used solely as the volatile oil.

As a result, a rate of occurrence of color irregularity was less than 10%. Further, no oil stuck thereto so that no degreasing process was required.

COMPARATIVE EXAMPLE 18

An aluminum fin working test was carried out similar to the Example 2, excepting that a mixture of a paraffinic mineral oil (kinematic viscosity of 8 cSt at a temperature of 40° C.) and olefinic acid with a weight ratio of 98:2 was used as the volatile oil.

As a result, the rate of occurrence of color irregularity was 3%, and a large quantity of the oil solvent stuck thereto so that a degreasing process was required.

EXAMPLES 44 TO 47 AND COMPARATIVE EXAMPLES 19 TO 22

Both side surfaces of magnetic disc substrates made of aluminum alloy (A5052 material) were subjected to a precise working process under the conditions listed below.

In this case, a degreasing process was eliminated. Further, as to relative surface roughness, the averaged surface roughness of the magnetic disc after working was measured so that value of averaged surface roughness/theoretical surface roughness (8.0 μm) was used as the relative surface roughness. The smaller the relative surface roughness (that is, it comes to be nearly equal to 1), the higher the working ability becomes.

The results of the test are shown in Table 14.

Conditions:

Working machine: lathe
Tool: diamond single crystal tool
Front End R value: R=0
End Cutting Edge Angle: $\theta=15°$
Rotational Speed: 500 rpm
Feed Speed: 0.05 mm/revolution
Cutting Depth: 15 μm
Cutting Rate: 60 m/min
Volatile Oil: Composition shown in Table 14

TABLE 14

| | Example | | | | Comparative Example | | | |
|---|---|---|---|---|---|---|---|---|
| | 44 | 45 | 46 | 47 | 19 | 20 | 21 | 22 |
| Composition | | | | | | | | |
| Straight chain-1-olefin *1 | 10 | 25 | 50 | 75 | 100 | — | — | — |
| Polybutene *2 | 90 | 75 | 50 | 25 | — | 100 | — | — |
| Paraffinic mineral oil *3 | — | — | — | — | — | — | 100 | 98 |
| Oiliness agent *4 | — | — | — | — | — | — | — | 2 |
| Effect | | | | | | | | |
| Relative surface roughness | 1.2 | 1.1 | 1.0 | 1.2 | 1.5 | 2.5 | 2.3 | 1.2 |
| Degreasing ability *5 | No | No | No | No | No | No | NO | Much |
| Working condition | *6 | *6 | *6 | *6 | *6 | *6 | *7 | *7 |

*1 A mixture of $C_{12}$ and $C_{14}$
*2 A boiling point of 165 to 200° C.
*3 Paraffinic mineral oil having a kinematic viscosity of 8 cSt at 40° C.
*4 Oleic acid
*5 Evaluation by amount of sticking oil
*6 Satisfactory
*7 Odor of oil As an emulsifier which is the component (v) of the working metal oil solvent, there can be exemplified (1) alkylene oxide adducts of polyhydric alcohol fatty acid ester, (2) alkylene oxide adducts of fatty acid having 8 to 30 carbon atoms, (3) alkylene adducts of polyhydric carboxylic acid having 4 to 36 carbon atoms, (4) alkaline soaps of fatty acid having 8 to 80 carbon atoms, (5) alkaline soaps of polyhydric carboxylic acid having 4 to 36 carbon atoms, (6) amine soaps of fatty acid having 8 to 30 carbon atoms or (7) amine soaps of polyhydric carboxylic acid having 4 to 36 carbon atoms, one or more kinds of these being used solely or in combination.

Incidentally, although there are various kinds of (1) alkylene oxide adducts of polyhydric alcohol fatty acid ester, there can be preferably exemplified, in general, such an adduct that alkylene oxide having 2 to 40 carbon atoms is added to ester of fatty acid with 8 to 30 carbon atoms of from dihydric to hexahydric alcohol having 2 to 6 carbon atoms, such as an ethylene oxide adduct of sorbitan monooleate, an ethylene oxide adduct of sorbitan monostearate, an ethylene oxide adduct of sorbitan monomyristylate, an ethylene oxide adduct of sorbitan monolaurate, or ethylene oxide adducts of di- or triester of them (for example, an ethylene oxide adduct of sorbitan dioleate, an ethylene oxide adduct of sorbitan trioleate and the like), or further, ethylene oxide adducts of sorbitan fatty acid ester such as ethylene oxidepropylene oxide adducts of mono- di- or triesters of them or the like. Further, there can be exemplified an alkylene oxide adduct of pentaerythritol fatty acid, an alkylene oxide adduct of glycerol fatty acid ester, an alkylene oxide adduct of glycol fatty acid ester, and the like.

(2) As the alkylene oxide adduct of fatty acid having 8 to 30 carbon atoms, there may be preferably exemplified alkylene oxide adducts of the fatty acid having 8 to 30 carbon atoms such as alkylene oxide adducts of lauric acid, myristic acid, stearic acid, oleic acid and the like.

(3) As the alkylene oxide adduct of polyhydric carboxylic acid having 4 to 36 carbon atoms, there can be preferably exemplified alkylene oxide adducts of the polyhydric carboxylic acid having 4 to 36 carbon atoms, such as alkylene oxide adducts of adipic acid, sebacic acid, dodecanic diacid, dimeric acid and the like.

(4) As the alkaline soap of aliphatic acid having 8 to 30 carbon atoms, there can be exemplified sodium or potassium soaps (salt) of lauric acid, miristic acid, stearic acid, oleic acid and the like.

(5) As the alkaline soap of polyhydric carboxylic acid having 4 to 36 carbon atoms, there can be exemplified sodium or potassium soaps of adipic acid, sebacic acid, dodecanic diacid, dimeric acid and the like.

(6) As the amine soap having 8 to 30 carbon atoms, there can be exemplified a salt of fatty acid having 8 to 30 carbon atoms and amine having 1 to 6 carbon atoms, such as mono- (dior tri) ethanol amine soap (salt) of lauric acid, myristic acid, stearic acid, oleic acid or the like.

(7) Further, as the amine soap of polyhydric carbon acid having 4 to 36 carbon atoms, there can be exemplified mono(di- or tri) ethanol amine soaps (salt) of adipic acid, sebacin acid, dodecanic diacid, dimer acid and the like.

In the above-mentioned metal working oil solvent or method of using this solvent, either one or more kinds of them (1) to (7) are used in combination. In the case of, for example, alkylene oxide adducts stated in (1) and (2), they preferably have 5 to 15 of HLB (hydrophilic and lipophilic balance) value. If it is less than 5, the detergency is sometimes low, and if it exceeds 15, there is a fear of separation from the above-mentioned basic material.

In the above-mentioned metal working oil solvent, although no limitation is given to the blending ratio of the above-mentioned emulsifier, it is usually selected within a range of 1 to 50 wt. %, preferably 2 to 30 wt. %, with respect to the entire oil. If the blending ratio of the emulsifier is less than 1 wt. %, the detergency is insufficient, and if it exceeds 50 wt. %, the working ability deteriorates.

Although the above-mentioned metal working oil solvent is constituted by blending an emulsifier into the above-mentioned basic oil, it can be suitably added with less than 10 wt. % of several kinds of additives such as an antioxidant, a corrosion inhibitor, an extreme pressure agent, a rust inhibitor and the like.

Meanwhile, in the metal working method according to the present invention, the above-mentioned metal working oil solvent is continuously or intermittently fed to the part of the metal (alloy) material to be worked as an object to be worked, or a water dispersion liquid in which water is dispersed is fed to the same, and thereafter it is washed by water. Further, it may be made in such a way that the metal material has been previously dipped in or coated with the above-mentioned metal working oil, and further, the oil is fed to the metal material which is being worked and which is thereafter washed by water, or, it may be made in such a way that after supply of the metal working oil, the metal material is fed thereto with a water dispersion liquid (emulsion) of the oil, and is then washed by water. The washing becomes effective by using not only water but also an alkaline water solution

EXAMPLE 48 (ALUMINUM FIN WORKING TEST)

An aluminum plate (A1200) having a thickness of 0.110 mm and coated thereover with water glass was subjected to the so-called drawless type working process so as to successively form aluminum fins for a household air-conditioner. That is, after dipping the aluminum plate in the oil, it was subjected to a piercing (drilling) process, a barring process, an ironing process and a reflaring process. The condition of the ironing process in this case was as follows:

Punch (cemented carbide) Outer Diameter: 9.86 mm
Dies (cemented carbide) Inner Diameter: 9.86 mm
Fin Pitch: 1.8 mm
Ironing Rate: 54%

Further, during the ironing process, a metal working oil (a basic material consisting of a mixture of straight chain-1-olefin (a mixture of $C_{12}$ and $C_{14}$) and polybutene (having a molecular weight of 260) with a weight ratio of 20:80, was added with 6 wt. % of an ethylene oxide adduct of sorbitan monooleate and 1.5 wt. % of an ethylene oxide adduct (having an HLB value of 13.5) of sorbitan monolaurate) was spray-coated over the aluminum plate.

It is noted that the continuous process was carried out in such a way that 32 holes per row were formed, and 100,000 strokes were carried out at a working rate of 250 strokes per minute.

After this working process, it was washed with water. During this washing, one set (100 pieces) of 70×50 mm aluminum fins was dipped in a water tank having a 1 ton volume for 5 min, and then was finished by washing them in a finishing washing tank (1 ton volume) for 1 min. Thereafter it was dried by hot air.

With the use of a part (flat part) which was cut out from the thus obtained fin, a contact angle of water drop was measured. The results of the measurement are shown in Table 15. It is noted that the smaller the contact angle, the more satisfactory the detergency becomes. Usually, it is preferable that the contact angle is less than 5 degrees. If the detergency is low, the efficiency of heat-exchange lowers.

EXAMPLE 49

An aluminum fin working test was carried out similar to Example 48, except that a metal working oil solvent which was obtained by adding 20 wt. % of potassium oleate to the basic material stated in Example 48 was used.

The results of the test are shown in Table 15.

COMPARATIVE EXAMPLE 23

An aluminum fin working test was carried out similar to Example 1, except that the base material stated in Example 48 was used alone as the metal working oil.

The results of the test are shown in Table 15.

COMPARATIVE EXAMPLE 24

An aluminum fin working test was carried out similar to Example 48, except that a metal working oil obtained by blending 6.5 wt. % of polyoxyethylene nonylphenylether (having an HLB value of 12) to the basic material stated in Example 48 was used.

The results of the test are shown in Table 15.

COMPARATIVE EXAMPLE 25

An aluminum fin working test was carried out similar to Example 48, except that a metal working oil obtained by blending 10 wt. % of petroleum Na-sulfonate to the basic material stated in Example 48, was used.

The results of the test are shown in Table 15.

TABLE 15

| No. | Color irregularity rate (%) | Seizure in ironed part | Water drop contact angle |
|---|---|---|---|
| Example 48 | 0 | No | 3° |
| Example 49 | 0 | No | 4° |
| Comparative Example 23 | 5 | No | 4° |
| Comparative Example 24 | 10 | No | 3° |
| Comparative Example 25 | 30 | Yes | 15° |

What is claimed is:

1. A lubricating oil composition for metal working, comprising:
   (i) a base oil containing, as an essential component, 0.5 to 99.5% by weight of at least one straight chain olefin having 6 to 40 carbon atoms; and
   (ii) at least one member of compounds selected from the group consisting of alcohol, glycol, polyalkylene glycol, a derivative of polyalkylene glycol and fatty acid.

2. A lubricating oil composition for metal working according to claim 1, wherein the straight chain olefin is a straight chain-α-olefin having 8 to 30 carbon atoms.

3. A lubricating oil composition for metal working according to claim 1, comprising the additional component of (iii) at least one member of compounds selected from the group consisting of phenolic compounds and amine compounds.

4. A lubricating oil composition for metal working according to claim 1, wherein said at least one member of compounds (ii) is contained in an amount of 50 parts by weight or less based on 100 parts by weight of the base oil.

5. A lubricating oil composition for metal working according to claim 1, wherein said at least one straight chain olefin having 6 to 40 carbon atoms is obtained by polymerizing ethylene.

6. A lubricating oil composition for metal working, comprising:

(i) a base oil which is a mixture of 0.5 to 99.5% by weight of at least one straight chain olefin having 6 to 40 carbon atoms and mineral oil and/or synthetic oil;

(ii) at least one member of compounds selected from the group consisting of alcohol, glycol, polyalkylene glycol and fatty acid.

7. A lubricating oil composition for metal working according to claim 6, wherein the straight chain olefin is a straight chain-α-olefin having 8 to 30 carbon atoms.

8. A lubricating oil composition for metal working according to claim 6, wherein the at least one member of compounds (ii) is contained in an amount of 50 parts by weight or less based on 100 parts by weight of the base oil.

9. A lubricating oil composition for metal working according to claim 6, wherein said at least one straight chain olefin having 6 to 40 carbon atoms is obtained by polymerizing ethylene.

10. A method of working metal materials, characterized by the step of continuously or intermittently feeding a volatile oil solution containing 5 to 50 wt. % of at least one straight chain olefin having not more than 14 carbon atoms and obtained by polymerization of ethylene and 95 to 50 wt. % of a solvent, onto the part to be worked during working the metal material.

11. A method of working metal materials according to claim 10, characterized in that said volatile oil solution contains as said solvent (iv) at least one member of solvents having a boiling point of not higher than 300° C., selected from the group consisting of polybutene, polypropylene and alcohol having 1 to 12 carbon atoms.

12. A working metal oil solvent, comprising:

(i) a basic oil containing, as an essential component 0.5 to 99.5% by weight of at least one straight chain olefin having 6 to 40 carbon atoms obtained by polymerizing ethylene; and (v) at least one member of emulsifiers selected from a group consisting of (1) an alkylene oxide adduct of polyhydric alcohol fatty acid ester, (2) an alkylene oxide adduct of fatty acid having 8 to 30 carbon atoms, (3) an alkylene oxide adduct of polyhydric carboxylic acid having 4 to 36 carbon atoms, (4) alkaline soap of fatty acid having 8 to 30 carbon atoms, (5) alkaline soap of polyhydric carboxylic acid having 4 to 36 carbon atoms, (6) amine soap of fatty acid having 8 to 30 carbon atoms, and (7) amine soap of polyhydric carboxylic acid having 4 to 36 carbon atoms.

13. A method of metal working, characterized in that the part to be worked is supplied with a metal working oil solvent of claim 12, or a dispersion liquid of said oil solvent, and thereafter, is rinsed.

14. An oil composition for working metal materials which comprises a volatile oil solution containing 5 to 50 wt. % of (i') at least one straight chain olefin having not more than 14 carbon atoms, obtained by polymerization of ethylene, and 95 to 50 wt. % of (iv) at least one member of solvents having a boiling point of not higher than 300° C., selected from the group consisting of polybutene, polypropylene and alcohol having 1 to 12 carbon atoms.

* * * * *